US008953747B2

(12) United States Patent
de Looz et al.

(10) Patent No.: US 8,953,747 B2
(45) Date of Patent: Feb. 10, 2015

(54) SHIELDING ELECTRODE FOR AN X-RAY GENERATOR

(75) Inventors: Marc-Andre de Looz, Princeton, NJ (US); Jani Reijonen, Princeton, NJ (US)

(73) Assignee: Schlumberger Technology Corporation, Sugar Land, TX (US)

( * ) Notice: Subject to any disclaimer, the term of this patent is extended or adjusted under 35 U.S.C. 154(b) by 498 days.

(21) Appl. No.: 13/432,948

(22) Filed: Mar. 28, 2012

(65) Prior Publication Data

US 2013/0259206 A1 Oct. 3, 2013

(51) Int. Cl.

| | |
|---|---|
| ***H01J 29/14*** | (2006.01) |
| ***H01J 29/58*** | (2006.01) |
| ***H01J 35/00*** | (2006.01) |
| ***H01J 35/06*** | (2006.01) |
| ***H01J 35/14*** | (2006.01) |

(52) U.S. Cl.
USPC ..... 378/143; 378/136; 378/134; 313/402

(58) Field of Classification Search
USPC ..... 378/121, 134, 136, 137, 143, 210; 313/40, 45, 238, 239, 240, 325, 333, 313/363.1, 402, 414, 416
See application file for complete search history.

(56) References Cited

U.S. PATENT DOCUMENTS

| | | | | |
|---|---|---|---|---|
| 3,903,424 | A | 9/1975 | Rose | |
| 4,032,810 | A | 6/1977 | Eastham et al. | |
| 5,267,296 | A * | 11/1993 | Albert | 378/113 |
| 5,490,197 | A * | 2/1996 | Albert et al. | 378/113 |
| 6,066,927 | A | 5/2000 | Koudijs | |
| 6,111,932 | A | 8/2000 | Dinsmore | |
| 7,564,948 | B2 * | 7/2009 | Wraight et al. | 378/101 |
| 7,668,293 | B2 | 2/2010 | Wraight et al. | |
| 7,817,781 | B2 * | 10/2010 | Wraight et al. | 378/119 |
| 7,960,687 | B1 * | 6/2011 | Simon et al. | 250/269.1 |
| 2007/0121788 | A1 * | 5/2007 | Mildner et al. | 378/138 |
| 2014/0263996 | A1 * | 9/2014 | Reijonen et al. | 250/256 |

OTHER PUBLICATIONS

International Search Report and Written Opinion for International Application No. PCT/US2013/034350 dated Jul. 25, 2013.

* cited by examiner

*Primary Examiner* — Bernard E Souw
(74) *Attorney, Agent, or Firm* — Cathy Hewitt

(57) ABSTRACT

An x-ray generator includes a voltage source and a voltage divider network coupled thereto, a housing, and an insulator carried within the housing. An emitter cathode is carried within the housing and emits electrons and undesirable conductive particles. In addition, there is a shielding electrode carried within the housing downstream of the emitter cathode and coupled to the voltage divider network. A target is carried within the housing downstream of the at least one shielding electrode. The voltage divider is configured so that the emitter cathode and the shielding electrode have a voltage difference therebetween such that an electric field generated in the housing accelerates electrons emitted by the emitter cathode to toward the target. The shielding electrode is shaped to capture the undesirable conductive particles emitted by the emitter cathode that would otherwise strike the insulator.

25 Claims, 3 Drawing Sheets

SHIELDING ELECTRODE FOR AN X-RAY GENERATOR

FIELD OF THE DISCLOSURE

This disclosure relates to an electron accelerator for use in an x-ray generator, and, more particularly, to an electrode for use in the electron accelerator.

BACKGROUND

Due to some drawbacks of well logging instruments utilizing gamma ray sources and gamma ray detectors, development of well logging instruments that instead utilize x-ray generators and x-ray detectors is desirable. As explained in U.S. Pat. No. 7,668,293 to Wraight et al., assigned to the same assignee as the present disclosure, an x-ray generator may include an electron accelerator and a target. The electron accelerator accelerates electrons toward the target at a speed sufficient such that, when the electrons are stopped by the target (which is sufficiently thick such that it can stop all electrons striking it), x-ray photons are produced, for example by Bremsstrahlung radiation.

While advances in x-ray sources, x-ray detectors, and methods of analyzing the data generated thereby have been made, for example in U.S. Pat. No. 7,960,687 to Simon et al., U.S. Pat. No. 7,817,781 to Wraight et al., and U.S. Pat. No. 7,564,948 to Wraight et al., all of which are assigned to the same assignee as the present disclosure, the electron accelerators previously used suffer from some drawbacks. For example, commonly used cathodes in electron accelerators emit not only electrons, but also conductive particles. These conductive particles may build up on insulating surfaces inside the electron accelerator, thereby changing the characteristics of those insulating surfaces. This in turn may undesirably affect the electric field inside the electron accelerator, and therefore alter the focus point of the electron beam, which may result in the electron beam not striking the intended portion of the target. The foregoing serves to degrade the performance of the x-ray generator, and thus the performance of the well logging instrument utilizing the x-ray generator.

As such, further advances in the area of electron accelerators for x-ray generators are desirable. It is desired for such new electron accelerators to reduce the buildup of undesirable conductive particles on insulating surfaces, and thus provide a high degree of stability and consistency, such that they can deliver a tightly focused electron beam to the target and consistently generate the desired x-ray photons.

SUMMARY

Generally speaking, an x-ray generator may include a housing, with an insulator carried within the housing. In addition an emitter cathode carried may be within the housing and may emit electrons and undesirable conductive particles, the undesirable conductive particles being emitted on a trajectory toward the insulator. At least one shielding electrode may be carried within the housing downstream of the emitter cathode. Further, a target may be carried within the housing downstream of the at least one shielding electrode.

The emitter cathode and the at least one shielding electrode may have a voltage difference therebetween such that an electric field generated in the housing accelerates electrons emitted by the emitter cathode to toward the target. The at least one shielding electrode may be shaped to capture the undesirable conductive particles emitted by the emitter cathode that would otherwise strike the insulator.

The at least one shielding electrode may also be shaped such that the electric field provides an electron optics lens to form an electron beam from the electrons emitted by the emitter cathode.

In some applications, The at least one shielding electrode may have a top portion having first and second ends defining a first axis therebetween, a bottom portion having a first and second ends defining a second axis therebetween, and an intermediate portion having first and second ends defining a third axis therebetween, with the second end of the top portion being coupled to the first end of the intermediate portion, and with the first end of the bottom portion being coupled to the second end of the intermediate portion. The third axis may not be parallel to the first axis and the second axis. The first axis and the second axis may be parallel. The third axis may be perpendicular to at least one of the first axis and the second axis.

The intermediate portion may be curved. An additional portion may extend outwardly from the second end of the bottom portion. The additional portion may extend perpendicularly outwardly from the second end of the bottom portion.

The at least one shielding electrode may comprise a plurality of shielding electrodes. In addition, there may be a plurality of puller electrodes carried within the housing downstream of the at least one shielding electrode and upstream of the target.

DETAILED DESCRIPTION

One or more embodiments of the present disclosure will be described below. These described embodiments are only examples of the presently disclosed techniques. Additionally, in an effort to provide a concise description, all features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1:
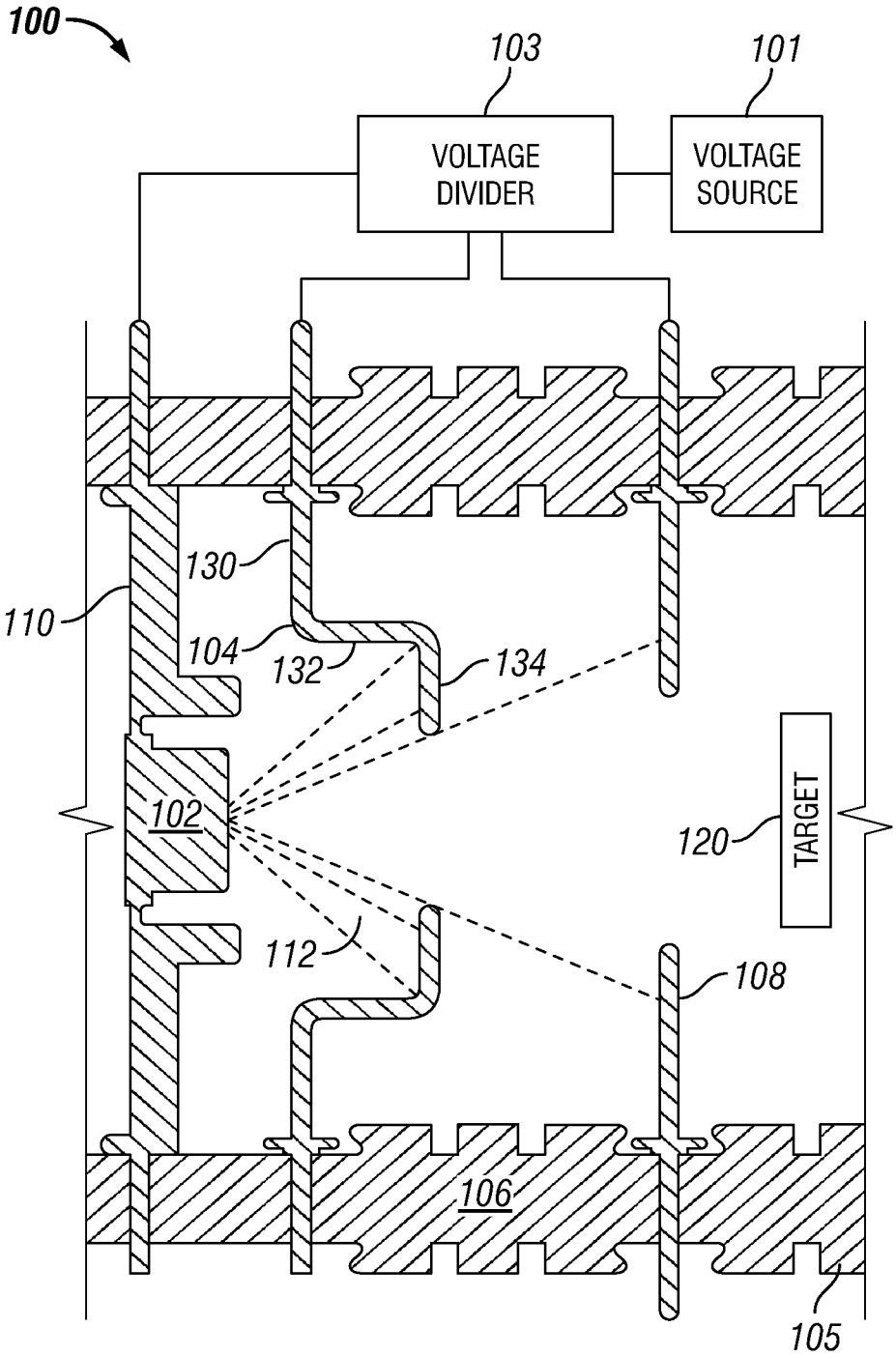
FIG. 1 is a schematic cross sectional view of a x-ray generator according to the present disclosure.

Referring initially to FIG. 1, an x-ray generator 100 comprises a voltage source 101 and a voltage divider network 103 coupled thereto. The x-ray generator 100 includes a housing 105 having an interior surface, with an insulator 106 on the interior surface. The housing 105 may be a vacuum tube, for example. The insulator 106 may be a high voltage insulator constructed from ceramic material, such as $Al_2O_3$. An emitter cathode 102 is carried within the housing 105 and coupled to the voltage divider network 103, the emitter cathode emitting electrons and undesirable conductive particles, during operation of the x-ray generator 100.

At least one shielding electrode 104 is carried within the housing 105 downstream of the emitter cathode 102 and coupled to the voltage divider network 103. Details of the shielding electrode 104 will be given below. It should be understood that there may be multiple such shielding electrodes successively arranged in a downstream direction. For example, there may be three shielding electrodes 104.

Figure 3:
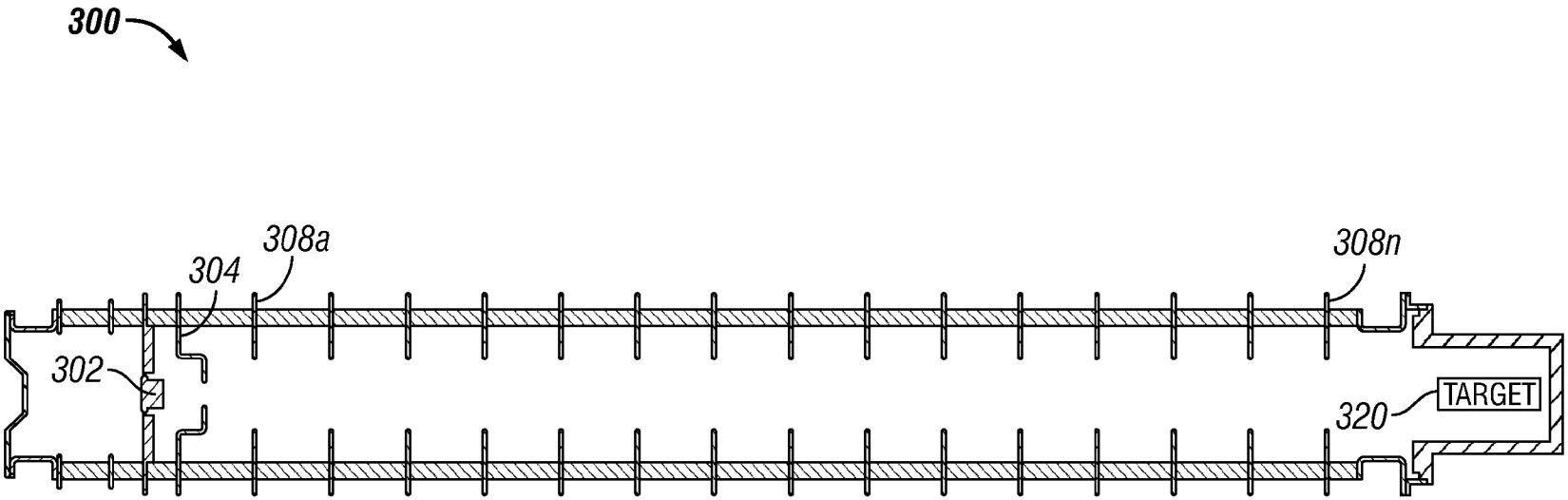
FIG. 3 is a schematic cross sectional view of a further x-ray generator according to the present disclosure.

At least one puller electrode 108 is carried within the housing 105 downstream of the emitter cathode 102, and is also coupled to the voltage divider network 103. It should be appreciated that there may be other puller electrodes in the housing 105, each downstream of the puller electrode 108 in succession, and each coupled to the voltage divider network 103. One such embodiment is shown in FIG. 3, where there are a plurality of puller electrodes 108*a* . . . 108*n*.

Referring again to FIG. 1, a target 120 is carried within the housing 105 downstream of the at least one shielding electrode 102, and may likewise be coupled to the voltage divider network 103. The voltage divider 103 is configured so that a negative potential is present at the emitter cathode 102, shielding electrode 104, and pulling electrode 108. An absolute value of this negative potential decreases in a downstream direction from the emitter cathode 102. For example, the emitter cathode 102 may be at −500 kV, while the shielding electrode 104 may be at −480 kV, while the puller electrode 108 may be at −460 kV, and while the target 120 is at 0 V.

During operation of the x-ray generator 100, the emitter cathode 102 emits electrons. The differences in potential between the emitter cathode 102, shielding electrode 104, and puller electrode 108 repel the electrons downstream toward the target 120. The target 120 is of an appropriate material such as gold and is sufficiently thick such that it can stop electrons striking it. When the electrons are stopped by the target 120, x-ray photons are produced via Bremsstrahlung radiation. The x-ray photons can be directed at a material, such as a formation in a borehole. The formation can reflect some of the x-ray photons, and these reflected x-ray photons may be captured by an x-ray detector. Monitoring of the x-ray detector, together with analysis of the data collected thereby, can then be used to determine properties of the material.

The emitter cathode 102 is constructed from a porous tungsten matrix with barium salt embedded therein. During operation of the x-ray generator 100, the emitter cathode 102 is heated to temperatures as high as, or higher than, 1000° C. At these high temperatures, the emitter cathode 102 emits electrons via thermionic emission. In addition, at these temperatures, the barium salt liquefies, and barium particles separate therefrom. These barium particles float to the surface of the emitter cathode 102 and help increase the electron emittance of the emitter cathode. However, the barium particles also boil off as electrons are emitted. These barium particles are electrically neutral, but are also electrically conductive.

Since the barium emitted from the emitter cathode 102 is at a high temperature, it may condense when it lands on a cooler surface. Therefore, if emitted barium particles land on the insulator 106, they may condense and build up over time. Portions of the surface of the insulator 106 might then become conductive. This would serve to alter the potential distribution between the emitter cathode 102, the shielding electrode 104, the puller electrode 108, and other components. This could alter the electric field in the housing 105, and thus alter the path or cohesiveness of the electron beam, which would degrade performance of the x-ray detector 100. Worse, with enough barium building up the insulator 106, a short could form between the emitter cathode 102 and shielding electrode 104, or between the shielding electrode 104 and the pulling electrode 108, for example. Such a short could result in damage to the x-ray detector 100 rendering it inoperable.

Another concern is if the barium particles land on the edge of the openings into which the shielding electrode 104 and pulling electrode 108 are inserted into the housing 105. In that case, there is a probability of secondary electron emission, which could alter the electric field in the housing 105 and thus alter the path or cohesiveness of the electron beam.

So as to avoid the above disadvantageous situations, the shielding electrode 104 is shaped to capture the barium emitted by the emitter cathode 102 that would otherwise strike and stick to the insulator 106. Potential trajectories 112 of the barium particles are shown in FIG. 1. As shown, the geometry of the shielding electrode 104 prevents the barium particles from striking the insulator 106. Instead, the barium particles may strike the shielding electrode 104 or puller electrode 108. Since these electrodes are already conductive, the effect of the barium condensing thereon on the electric field is negligible. In addition to shielding the insulator 106 from the barium particles, the shielding electrode 104 may also shield the insulator from undesirable charged particles that may be emitted by the emitter cathode 102.

As shown in FIG. 1, the shielding electrode 104 has a top portion 130, a bottom portion 134, and an intermediate portion 132 connecting the top portion and the bottom portion. The top portion 130 defines a first axis, and the bottom portion 134 defines a second axis parallel to the first axis. The intermediate portion 132 defines a third axis that not parallel to the first axis and the second axis. The third axis is illustratively perpendicular to the first axis and the second axis, but it should be understood that the third axis need not be perpendicular to the first axis and the second axis.

As explained above, the shielding electrode 104 shields the insulator 106 from the barium particles. Depending on the geometry of the shielding electrode 104, however, it may also serve as a lens element by altering the electric field in the housing 105 such that the electric field focuses the accelerated electrons into an electron beam from the cathode to the target.

Figure 2:
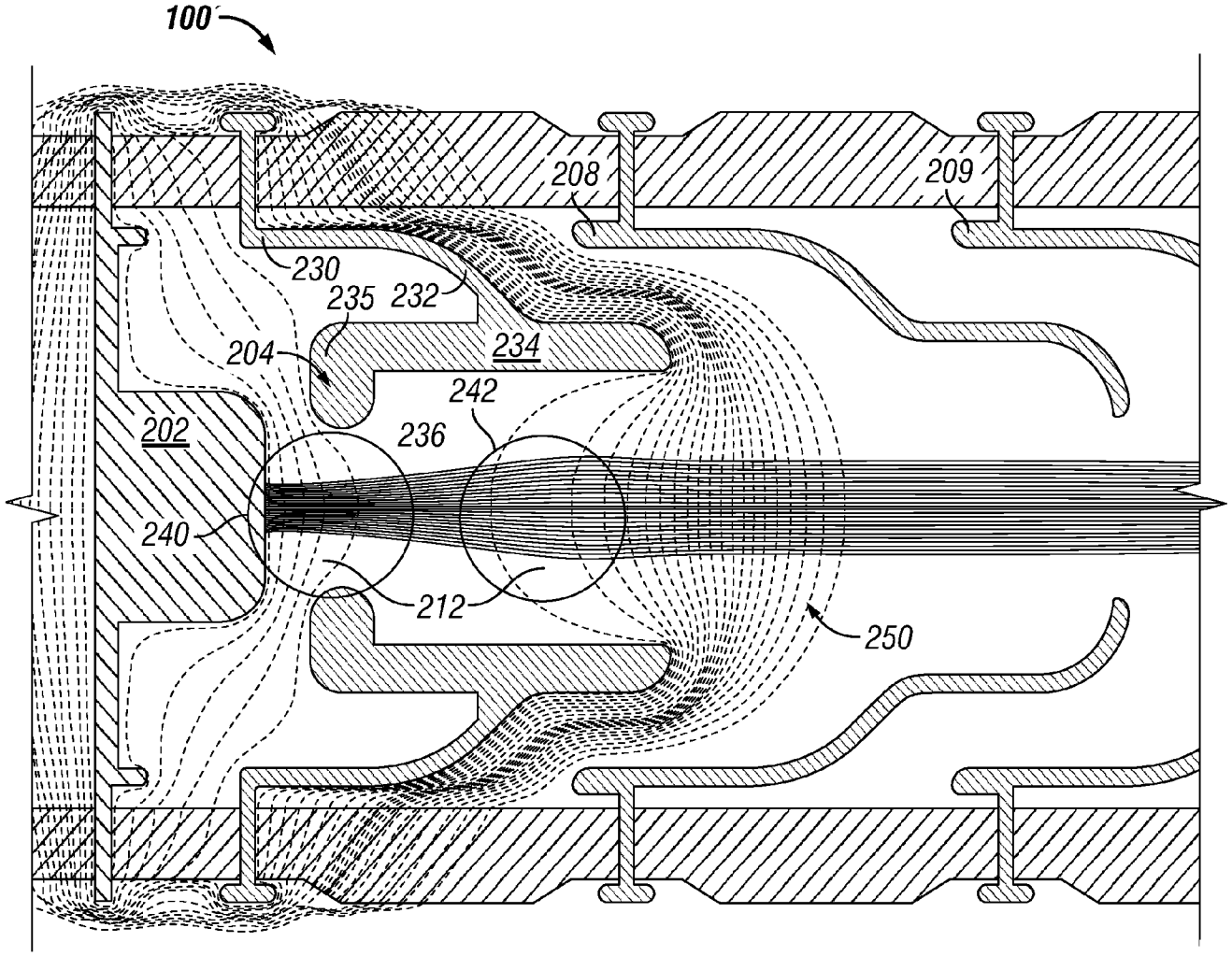
FIG. 2 is a schematic cross sectional view of another x-ray generator including electric field lines according to the present disclosure.

One such application is shown in FIG. 2, and will now be described. Here, the voltage source and voltage divider are not shown for clarity, although it should be understood that they are present. Here, the emitter cathode 202 may have a surface of carbon nanotubes, and the shielding electrode 204 is positioned adjacent the emitter cathode. The shielding electrode 204 comprises a top portion 230, a bottom portion 234, and an intermediate portion 232 connecting the top portion and the bottom portion. The top portion 230 defines a first axis, and the bottom portion 234 defines a second axis parallel to the first axis. The intermediate portion 232 defines a third axis that not parallel to the first axis and the second axis The intermediate portion 232 is curved. The bottom portion 234 comprises a first portion 235 coupled to the intermediate portion 232, and a second portion 236 extending outwardly from the first portion. The second portion 236 illustratively extends perpendicularly outwardly from the first portion 235, although it should be understood that it need not extend perpendicularly outwardly.

The electric field 250 present in the housing 205 is shown in FIG. 2 as a series of lines. The foregoing geometry of the shielding electrode 204, as well as that of the puller electrodes 208, 209, causes the electric field 250 to form first and second lensing points 240, 242. At the first lensing point 240, the electron beam is expanded to reach a desired diameter, and at the second lensing point 242, the beam is constrained to the desired diameter. This helps deliver a focused beam to the target (also not shown) such that the desired x-ray photons are produced.

The lensing points 240, 242 are products of the curved potentials at the opening of the shielding electrode 204. To understand this, let us think of a vector perpendicular to the potential line. When the potential line is curved, this vector points upwards, or downwards depending on its location on the curved potential line. This vector is called the electric field vector. This field will push charged particles. An upward pointing vector has two components, one along the x-axis (beam axis) and one along the y-axis (perpendicular to the beam axis). The magnitude of the vector component perpendicular to the beam axis defines the 'kick' a charged particle receives from the electric field, when at this location. The more curved potential, the more 'kick' the particle will receive in a direction perpendicular to the axis. This makes the beam to spread on the left side of the shielding electrode 204, when the potentials are bulging downstream. The opposite happens on the right side of the shielding electrode 204, where the potentials are bulging upstream, and this makes the beam focus again. By playing with the opening in the shield electrode 204 and the potentials between the emitter cathode 202, the shielding electrode 204, and the first accelerator electrode 208, the beam can be focused, while insulators 206 is shielded from contaminants.

While the disclosure has been described with respect to a limited number of embodiments, those skilled in the art, having benefit of this disclosure, will appreciate that other embodiments can be envisioned that do not depart from the scope of the disclosure as disclosed herein. Accordingly, the scope of the disclosure shall be limited only by the attached claims.

That which is claimed is:

1. An x-ray generator comprising:

a vacuum tube;

an insulator carried within the vacuum tube;

an emitter cathode carried within the insulator and emitting electrons and neutral conductive particles, the neutral conductive particles being emitted on a trajectory toward the insulator;

at least one shielding electrode carried within the insulator downstream of the emitter cathode; and a target carried within the insulator downstream of the at least one shielding electrode;

the emitter cathode and the at least one shielding electrode having a voltage difference therebetween such that an electric field generated in the housing accelerates the electrons toward the target;

the at least one shielding electrode being shaped to capture the neutral conductive particles emitted by the emitter cathode that would otherwise strike the insulator;

the target emitting x-rays when struck by the electrons.

2. An x-ray generator according to claim 1, wherein the at least one shielding electrode is also shaped such that the electric field provides an electron optics lens to form an electron beam from the electrons emitted by the emitter cathode.

3. An x-ray generator according to claim 1, wherein the at least one shielding electrode comprises a top portion having first and second ends defining a first axis therebetween, a bottom portion having a first and second ends defining a second axis therebetween, an intermediate portion having first and second ends defining a third axis therebetween, the second end of the top portion being coupled to the first end of the intermediate portion, the first end of the bottom portion being coupled to the second end of the intermediate portion; and wherein the third axis is not parallel to the first axis and the second axis.

4. An x-ray generator according to claim 3, wherein the first axis and the second axis are parallel.

5. An x-ray generator according to claim 3, wherein the third axis is perpendicular to at least one of the first axis and the second axis.

6. An x-ray generator according to claim 3, wherein the intermediate portion is curved.

7. An x-ray generator according to claim 6, further comprising an additional portion extending outwardly from the second end of the bottom portion.

8. An x-ray generator according to claim 7, wherein the additional portion extends perpendicularly outwardly from the second end of the bottom portion.

9. An x-ray generator according to claim 1, wherein the at least one shielding electrode comprises a plurality of shielding electrodes.

10. An x-ray generator according to claim 1, further comprising a plurality of puller electrodes carried within the insulator downstream of the at least one shielding electrode.

11. A particle accelerator comprising:

an insulator;

an emitter cathode carried within the insulator, the emitter cathode emitting electrons and neutral conductive particles, the neutral conductive particles being emitted on a trajectory toward the insulator; and at least one shielding electrode carried within the insulator downstream of the emitter cathode and being shaped to capture the neutral conductive particles emitted by the emitter cathode that would otherwise strike the insulator.

12. An electron accelerator according to claim 11, wherein the at least one shielding electrode is also shaped such that an electric field in the insulator provides an electron optics lens to form an electron beam from the electrons emitted by the emitter cathode.

13. An electron accelerator according to claim 11, wherein the at least one shielding electrode comprises a top portion having first and second ends defining a first axis therebetween, a bottom portion having a first and second ends defining a second axis therebetween, an intermediate portion having first and second ends defining a third axis therebetween, the second end of the top portion being coupled to the first end of the intermediate portion, the first end of the bottom portion being coupled to the second end of the intermediate portion; and wherein the third axis is not parallel to the first axis and the second axis.

14. An electron accelerator according to claim 13, wherein the first axis and the second axis are parallel.

15. An electron accelerator according to claim 13, wherein the third axis is perpendicular to at least one of the first axis and the second axis.

16. An electron accelerator according to claim 13, wherein the intermediate portion is curved.

17. An electron accelerator according to claim 14, further comprising an additional portion extending outwardly from the second end of the bottom portion.

18. An electron accelerator according to claim 17, wherein the additional portion extends perpendicularly outwardly from the second end of the bottom portion.

19. A method of generating x-rays comprising:

emitting electrons and neutral conductive particles, the neutral conductive particles being emitted on a trajectory toward an insulator, using an emitter cathode carried within the insulator; and accelerating the electrons toward a target within the insulator, and shielding the insulator from the neutral conductive particles that would otherwise strike the insulator, using at least one shielding electrode carried within the insulator downstream of the emitter cathode, the target being downstream of the at least one shielding electrode.

20. A method according to claim 19, further comprising forming an electron beam from the electrons emitted by the emitter cathode using an electron optics lens formed by an electric field generated inside the insulator.

21. A method according to claim 19, wherein the at least one shielding electrode comprises a top portion having first and second ends defining a first axis therebetween, a bottom portion having a first and second ends defining a second axis therebetween, an intermediate portion having first and second ends defining a third axis therebetween, the second end of the top portion being coupled to the first end of the intermediate portion, the first end of the bottom portion being coupled to the second end of the intermediate portion; and wherein the third axis is not parallel to the first axis and the second axis.

22. A method according to claim 21, wherein the first axis and the second axis are parallel.

23. A method according to claim 21, wherein the third axis is perpendicular to at least one of the first axis and the second axis.

24. A method according to claim 21, wherein the intermediate portion is curved.

25. A method according to claim 24, further comprising an additional portion extending outwardly from the second end of the bottom portion.

* * * * *